US009148913B2

(12) United States Patent
Lee et al.

(10) Patent No.: US 9,148,913 B2
(45) Date of Patent: Sep. 29, 2015

(54) BACKLIGHT MODULE TRANSMITTING ELECTRICITY THROUGH MAGNETIC FIELD INDUCTION

(71) Applicant: Au Optronics Corporation, Hsinchu (TW)

(72) Inventors: Tsung-Shiun Lee, Tainan (TW); Huang-Ti Lin, Hsinchu County (TW); Bing-Shiang Hsu, Taichung (TW)

(73) Assignee: Au Optronics Corporation, Hsinchu (TW)

( * ) Notice: Subject to any disclaimer, the term of this patent is extended or adjusted under 35 U.S.C. 154(b) by 259 days.

(21) Appl. No.: 13/896,330

(22) Filed: May 17, 2013

(65) Prior Publication Data

US 2014/0077698 A1 Mar. 20, 2014

(30) Foreign Application Priority Data

Sep. 19, 2012 (TW) ..... 101134317 A

(51) Int. Cl.
*H05B 37/00* (2006.01)
*H05B 39/00* (2006.01)
*H05B 33/08* (2006.01)

(52) U.S. Cl.
CPC ..... *H05B 33/0806* (2013.01); *H05B 33/086* (2013.01)

(58) Field of Classification Search
CPC ..... H05B 33/0806; H05B 33/086
USPC ..... 315/185 R, 219, 291, 294, 312; 345/102
See application file for complete search history.

(56) References Cited

U.S. PATENT DOCUMENTS

| | | | | |
|---|---|---|---|---|
| 5,929,733 | A * | 7/1999 | Anzawa et al. | 336/61 |
| 7,196,483 | B2 | 3/2007 | Wey et al. | |
| 7,358,684 | B2 | 4/2008 | Wey et al. | |
| 8,525,428 | B2 * | 9/2013 | Chen et al. | 315/219 |
| 8,531,125 | B2 * | 9/2013 | Kim et al. | 315/279 |
| 8,598,807 | B2 * | 12/2013 | Ji et al. | 315/294 |
| 8,629,627 | B2 * | 1/2014 | Cohen et al. | 315/291 |
| 8,686,650 | B2 * | 4/2014 | Shimura | 315/188 |

(Continued)

FOREIGN PATENT DOCUMENTS

| | | |
|---|---|---|
| CN | 1832649 | 9/2006 |
| CN | 1971363 | 5/2007 |

(Continued)

OTHER PUBLICATIONS

"Office Action of China Counterpart Application", issued on Apr. 28, 2014, p. 1-p. 7.

*Primary Examiner* — Kenneth B Wells
(74) *Attorney, Agent, or Firm* — Jianq Chyun IP Office

(57) ABSTRACT

A backlight module is provided, which includes a first coil, a first driving circuit, a second coil, a rectifying circuit and a light emitting unit. The first driving circuit is electrically connected to the first coil for controlling the first coil to produce a first magnetic field. The second coil is disposed on a transmission direction of the first magnetic field corresponding to the first coil for receiving the first magnetic field and providing a first induction voltage according to the first magnetic field. The rectifying circuit is electrically connected to the second coil for converting the first induction voltage into a first driving voltage. The light emitting unit is electrically connected to the rectifying circuit to provide a backlight according to the first driving voltage.

8 Claims, 10 Drawing Sheets

(56) References Cited

U.S. PATENT DOCUMENTS

| | | | | |
|---|---|---|---|---|
| 2006/0284569 | A1* | 12/2006 | Wey et al. | 315/282 |
| 2007/0152606 | A1 | 7/2007 | Wey et al. | |
| 2009/0096413 | A1 | 4/2009 | Partovi et al. | |
| 2011/0012936 | A1* | 1/2011 | Kim | 345/690 |
| 2011/0156615 | A1* | 6/2011 | Chang et al. | 315/297 |
| 2011/0248638 | A1 | 10/2011 | Aso | |
| 2012/0268024 | A1* | 10/2012 | Chang et al. | 315/201 |

FOREIGN PATENT DOCUMENTS

| | | |
|---|---|---|
| TW | 200719304 | 5/2007 |
| TW | 201134294 | 10/2011 |
| TW | I354961 | 12/2011 |
| TW | M423417 | 2/2012 |
| TW | M428620 | 5/2012 |

* cited by examiner

BACKLIGHT MODULE TRANSMITTING ELECTRICITY THROUGH MAGNETIC FIELD INDUCTION

CROSS-REFERENCE TO RELATED APPLICATION

This application claims the priority benefit of Taiwan application serial no. 101134317, filed on Sep. 19, 2012. The entirety of the above-mentioned patent application is hereby incorporated by reference herein and made a part of this specification.

BACKGROUND OF THE INVENTION

1. Field of the Invention

The invention generally relates to a backlight module, and more particularly, to a backlight module able to transmit electricity through the magnetic field induction.

2. Description of Related Art

The liquid crystal display (LCD), due to low-voltage operation, no radiation scattering, light weight and small size, has significant advantages which the traditional display based on cathode ray tube (CRT) can not achieve, so that the LCD has become the major project for display development in recent years and continues to progress towards the colorization. The LCD is a non-self-luminous display and requires a backlight module to provide appropriate light for displaying. In recent years, with the enhancement of environmental awareness, the light emitting element used in the backlight module has been gradually converted from the cold cathode fluorescent lamp (CCFL) into the more environment-friendly light emitting diode (LED).

However, due to the factors of the connector of LED light bars, driving circuit and power line layout and others, the backlight module encounters a design problem for further compacting the volume itself

SUMMARY OF THE INVENTION

Accordingly, the embodiments of these invention provide a backlight module, which is able to simplify and reduce the circuit layout therein through the magnetic field induction between the coils so as to further reduce the volume and get disposing convenience.

The invention provides a backlight module, which includes a first coil, a first driving circuit, a second coil, a rectifying circuit and a light emitting unit. The first driving circuit is electrically connected to the first coil for controlling the first coil to produce a first magnetic field. The second coil is disposed on a transmission direction of the first magnetic field corresponding to the first coil for receiving the first magnetic field and providing a first induction voltage according to the first magnetic field. The rectifying circuit is electrically connected to the second coil for converting the first induction voltage into a first driving voltage. The light emitting unit is electrically connected to the rectifying circuit to provide a backlight according to the first driving voltage.

In an embodiment of the invention, the backlight module further includes a first substrate having a first surface and a second surface opposite to the first surface, in which the first coil and the first driving circuit are disposed at a side of the first substrate the same as the first surface, and the second coil, the rectifying circuit and the light emitting unit are disposed at another side of the first substrate the same as the second surface.

In an embodiment of the invention, the first coil and the second coil are respectively a coil pattern printed on the first substrate.

In an embodiment of the invention, the light emitting unit includes an LED light bar and the second coil is disposed at a second substrate of the LED light bar.

In an embodiment of the invention, the first coil is a coil pattern printed on the first substrate, and the second coil is a coil pattern printed on a second substrate of the LED light bar.

In an embodiment of the invention, the rectifying circuit is electrically connected between the second coil and the LED light bar and includes a first diode, a second diode, a third diode, a fourth diode and a first capacitor. The anode of the first diode is electrically connected to first terminal of the second coil. The cathode of the second diode is electrically connected to the anode of the first diode. The anode of the third diode is electrically connected to second terminal of the second coil and the cathode of the third diode is electrically connected to the cathode of the first diode. The cathode of the fourth diode is electrically connected to the anode of the third diode and the anode of the fourth diode is electrically connected to the anode of the second diode. The first capacitor is electrically connected between the cathode of the first diode and the anode of the second diode for providing the first driving voltage.

In an embodiment of the invention, the first driving circuit is further for receiving a switch driving signal and the first driving circuit includes a voltage source and a first switching component. The voltage source is electrically connected to the first terminal of the first coil for providing a first voltage to the first terminal of the first coil. The first switching component is electrically connected between the second terminal of the first coil and a second voltage for providing the second voltage to the second terminal of the first coil according to the switch driving signal.

In an embodiment of the invention, the first driving circuit further includes a second switching component, which is electrically connected between the first terminal and the second terminal of the first coil and is turned on according to the inverse signal of the switch driving signal, in which the first switching component includes a first transistor, the first terminal of the first transistor is electrically connected to the second terminal of the first coil, second terminal of the first transistor receives the second voltage and the control terminal of the first transistor receives the switch driving signal. In addition, the second switching component includes a second transistor, in which the first terminal of the second transistor is electrically connected to the first terminal of the first coil, the second terminal of the second transistor is electrically connected to the second terminal of the first coil and the control terminal of the second transistor receives the inverse signal of the switch driving signal.

In an embodiment of the invention, the first driving circuit is also used to receive a switch driving signal and the first driving circuit includes a voltage source, a third switching component and a fourth switching component. The voltage source is for providing a first voltage. The third switching component is electrically connected between the voltage source and the first terminal of the first coil for providing the first voltage to the first terminal of the first coil according to the switch driving signal. The fourth switching component is electrically connected between the first terminal and the second terminal of the first coil and is turned on according to the inverse signal of the In an embodiment of the invention, the third switching component includes a third transistor, in which the first terminal of the third transistor is electrically connected to the voltage source, the second terminal of the third transistor is electrically connected to the first terminal of the first coil and the control terminal of the third transistor receives the switch driving signal. The fourth switching component includes a fourth transistor, in which the first terminal of the fourth transistor is electrically connected to the first terminal of the first coil, the second terminal of the fourth transistor is electrically connected to the second terminal of the first coil and the control terminal of the fourth transistor receives the inverse signal of the switch driving signal.

In an embodiment of the invention, the switch driving signal is provided by a control chip, the control chip includes a timing controller and the switch driving signal is provided by the timing controller.

In an embodiment of the invention, the backlight module further includes a third coil and a fourth coil. The third coil is electrically connected to the first driving circuit and produces a second magnetic field under controlling of the first driving circuit. The fourth coil is electrically connected to the rectifying circuit, is disposed on a transmission direction of the second magnetic field opposite to the third coil and is used to receive the second magnetic field and provide a second induction voltage to the rectifying circuit according to the second magnetic field, in which the rectifying circuit converts the second induction voltage into a second driving voltage, and the light emitting unit provides the backlight according to the first driving voltage and the second driving voltage.

Based on the description above, the backlight module in the embodiment of the invention takes advantage of the induction action of magnetic fields between the first coil and the second coil to make the first driving circuit wirelessly control the light emitting unit for providing a backlight. In this way, the volume of the backlight module can be reduced due to a fewer circuits, which further reduces the design cost of the backlight module and easier disposes the backlight module in an LCD.

Other objectives, features and advantages of the present invention will be further understood from the further technological features disclosed by the embodiments of the present invention wherein there are shown and described preferred embodiments of this invention, simply by way of illustration of modes best suited to carry out the invention.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DESCRIPTION OF THE EMBODIMENTS

Figure 1:
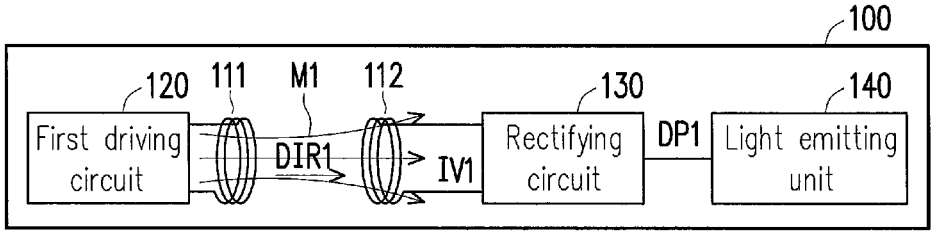
FIG. 1 is a function block diagram of a backlight module according to an embodiment of the invention.

FIG. 1 is a function block diagram of a backlight module according to an embodiment of the invention. Referring to FIG. 1, in the embodiment, the backlight module 100 includes a first coil 111, a second coil 112, a first driving circuit 120, a rectifying circuit 130 and a light emitting unit 140. The first driving circuit 120 is electrically connected to the first coil 111 for controlling the first coil 111 to produce a first magnetic field M1. The second coil 112 is disposed on a transmission direction DIR1 of the first magnetic field M1 corresponding to the first coil 111 for receiving the first magnetic field M1 and providing a first induction voltage IV1 according to the first magnetic field M1. The rectifying circuit 130 is electrically connected to the second coil 112 for converting the first induction voltage IV1 into a first driving voltage DP1. The light emitting unit 140 is electrically connected to the rectifying circuit 130 for providing a backlight according to the first driving voltage DP1, in which the light emitting unit 140 can include at least one LED light bar.

In the embodiment, since the first coil 111 take advantage of induction of magnetic field to make the second coil 112 produce the first induction voltage IV1, so that no circuit connection is needed between the first coil 111 and the second coil 112 to achieve electric transmission effect. As a result, the dimension of the backlight module 100 can be effectively reduced due to a fewer circuits and the fabrication cost is accordingly reduced. In addition, the space size and the relative position layout between the first coil 111 and the second coil 112 can be not entirely corresponding to each other, in which it is required only the intensity of the first magnetic field M1 received by the second coil 112 is sufficient to make the second coil 112 produce the first induction voltage IV1. In other words, the positions of the first coil 111 and the second coil 112 do not require to be corresponding to each other, instead, it is needed they are partially overlapped with each other.

Figure 2:
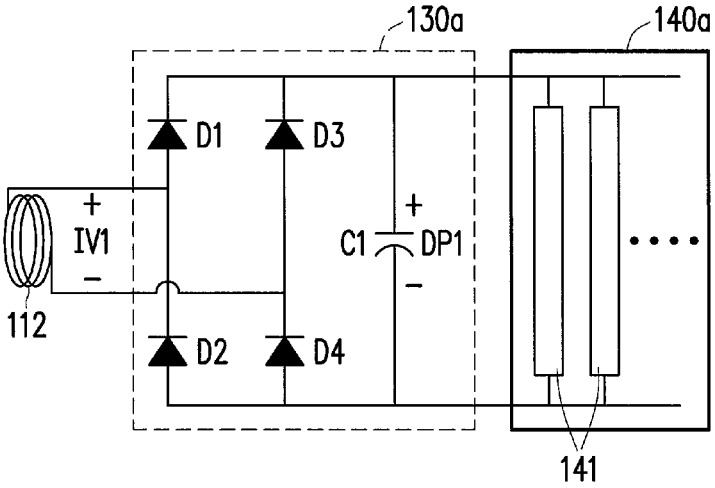
FIG. 2 is a schematic implementation diagram of the architectures of the coils, the rectifying circuit and the light emitting unit in FIG. 1.

FIG. 2 is a schematic implementation diagram of the architectures of the coils, the rectifying circuit and the light emitting unit in FIG. 1. Referring to FIGS. 1 and 2, in the embodiment, the light emitting unit includes a plurality of LED light bars 141 and the rectifying circuit 130*a* is electrically connected to between the second coil 112 and the LED light bars 141.

The rectifying circuit 130*a* includes a first diode D1, a second diode D2, a third diode D3, a fourth diode D4 and a first capacitor C1. The anode of the first diode D1 is electrically connected to first terminal of the second coil 112. The cathode of the second diode D2 is electrically connected to the anode of the first diode D1. The anode of the third diode D3 is electrically connected to second terminal of the second coil 112 and the cathode of the third diode D3 is electrically connected to the cathode of the first diode D1. The cathode of the fourth diode D4 is electrically connected to the anode of the third diode D3 and the anode of the fourth diode D4 is electrically connected to the anode of the second diode D2. The first capacitor C1 is electrically connected between the cathode of the first diode D1 and the anode of the second diode D2 for providing the first driving voltage DP1.

Specifically, after the second coil 112 produces the first induction voltage IV1, the rectifying circuit 130*a* can convert the first induction voltage IV1 into the first driving voltage DP1 through, for example, a full-bridge rectifier circuit (composed of the first diode D1, the second diode D2, the third diode D3 and the fourth diode D4). It should be noted that the circuit configuration in the rectifying circuit 130*a* herein is an example only, the user can design it by himself or according to the design requirement of the people skilled in the art.

Figure 3:
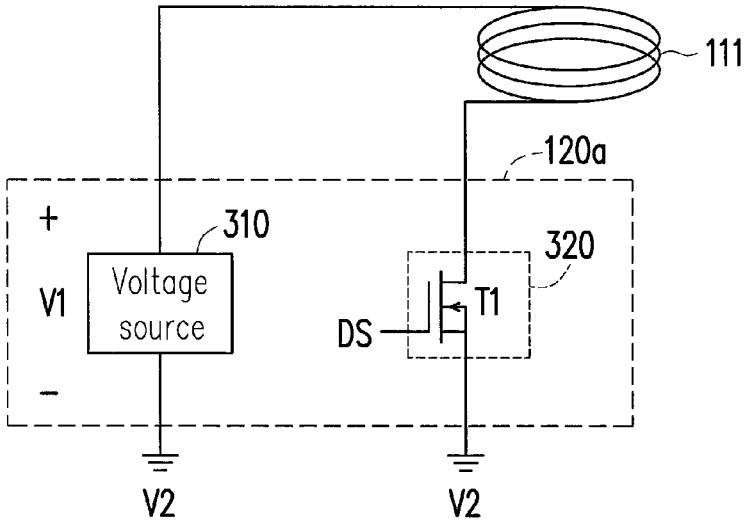
FIGS. 3-6 are schematic diagrams showing the connection configuration between the first driving circuit and the first coil according to an embodiment of the invention.

FIG. 3 is a schematic diagram showing the connection configuration between the first driving circuit and the first coil according to an embodiment of the invention. Referring to FIGS. 1 and 3, in the embodiment, the first driving circuit 120*a* receives a switch driving signal DS and includes a voltage source 310 and a first switching component 320. The first terminal of the voltage source 310 is electrically connected to the first terminal of the first coil 111 for providing a first voltage V1 to the first terminal of the first coil 111 and the second terminal of the voltage source 310 is electrically connected to a second voltage V2. The first switching component 320 is electrically connected between the second terminal of the first coil 111 and the second voltage V2 for been turned on according to the switch driving signal DS, and the first switching component 320 during being turned on would provide the second voltage V2 to the second terminal of the first coil 111, in which the first voltage V1 is different from the second voltage V2 and the second voltage V2 can be a ground voltage.

The first driving circuit 320 in the embodiment, for example, includes a first transistor T1, in which the drain (corresponding to first terminal) of the first transistor T1 is electrically connected to the second terminal of the first coil 111, the source (corresponding to second terminal) of the first transistor T1 receives the second voltage V2 and the gate (corresponding to control terminal) of the first transistor T1 receives the switch driving signal DS.

Figure 4:
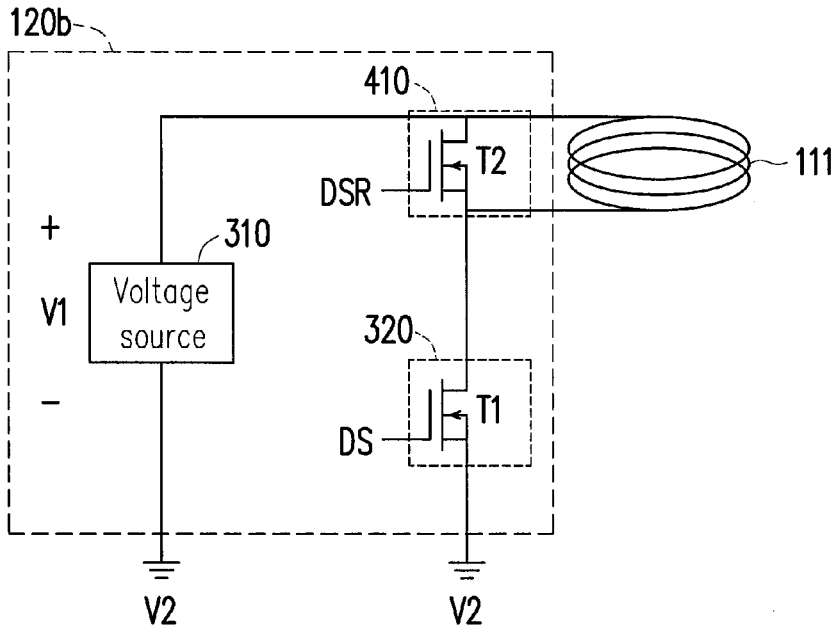

FIG. 4 is a schematic diagram showing the connection configuration between the first driving circuit and the first coil according to an embodiment of the invention. Referring to FIGS. 1, 3 and 4, the difference of the connection configuration from FIG. 3 rests in that the first driving circuit 120*b* in the embodiment further receives a switch driving signal DSR and further includes a second switching component 410. The second switching component 410 is electrically connected between the first terminal and the second terminal of the first coil 111 and can be turned on according to the switch driving signal DSR (it is herein, for example, the inverse signal of the switch driving signal DS). In other words, when the first switching component 320 is turned on under the controlling of the switch driving signal DS, the second switching component 410 is correspondingly turned off under the controlling of the switch driving signal DSR.

In the embodiment, the second switching component 410 includes, for example, a second transistor T2, in which the drain (corresponding to first terminal) of the second transistor T2 is electrically connected to the first terminal of the first coil 111, the source (corresponding to second terminal) of the second transistor T2 is electrically connected to the second terminal of the first coil 111 and the gate (corresponding to control terminal) of the second transistor T2 receives the switch driving signal D SR.

Figure 5:
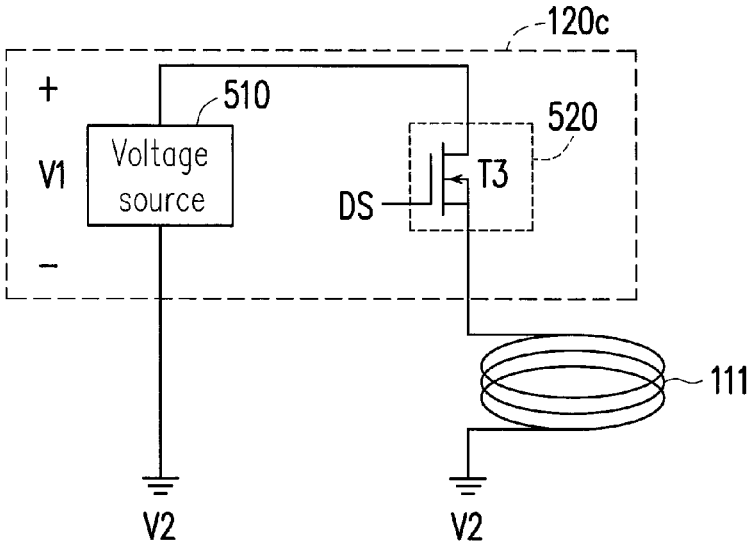

FIG. 5 is a schematic diagram showing the connection configuration between the first driving circuit and the first coil according to an embodiment of the invention. Referring to FIGS. 1 and 5, in the embodiment, the first driving circuit 120*c* receives a switch driving signal DS and includes a voltage source 510 and a third switching component 520. The voltage source 510 provides a first voltage V1. The first terminal of the third switching component 520 is electrically connected to the first terminal of the voltage source 510, the second terminal of the voltage source 510 is electrically connected to a second voltage V2 and the first coil 111 is electrically connected between the second terminal of the third switching component 520 and the second voltage V2. The third switching component 520 would be turned on according to the switch driving signal DS, and the third switching component 520 during being turned on would provide the first voltage V1 to the first terminal of the first coil 111.

In the embodiment, the third switching component 520 includes, for example, a third transistor T3, in which the drain (corresponding to first terminal) of the third transistor T3 is electrically connected to the first terminal of the voltage source 510, the first coil 111 is electrically connected between the source (corresponding to second terminal) of the third transistor T3 and the second voltage V2, and the gate (corresponding to control terminal) of the third transistor T3 receives the switch driving signal DS.

Figure 6:
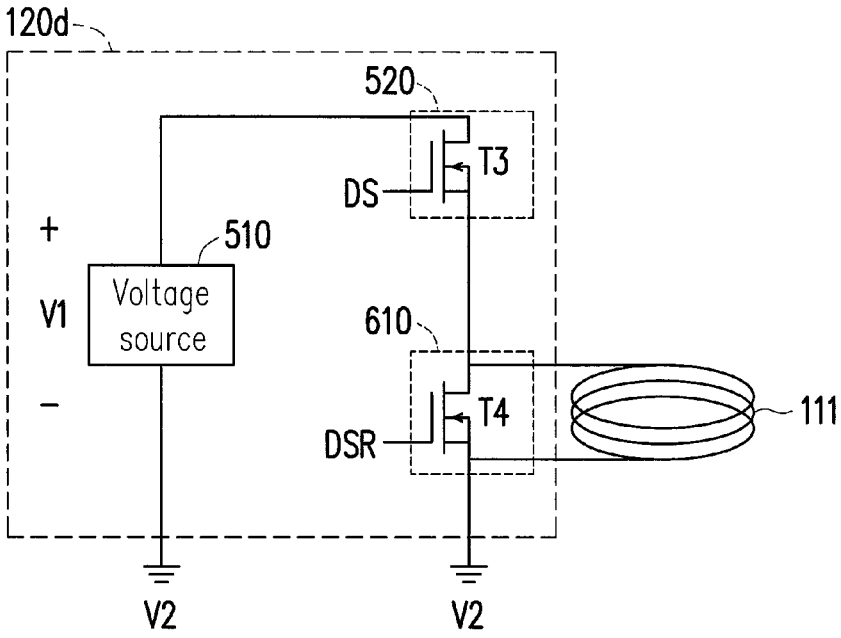

FIG. 6 is a schematic diagram showing the connection configuration between the first driving circuit and the first coil according to an embodiment of the invention. Referring to FIGS. 1, 5 and 6, the difference of the connection configuration from FIG. 5 rests in that the first driving circuit 120*d* in the embodiment further receives a switch driving signal DSR and further includes a fourth switching component 610. The fourth switching component 610 is electrically connected between the first terminal and the second terminal of the first coil 111 and can switch the on/off state thereof under the controlling of the switch driving signal DSR (i.e., the inverse signal of the switch driving signal DS). In other words, when the third switching component 520 is turned on under the controlling of the switch driving signal DS, the fourth switching component 610 is correspondingly turned off under the controlling of the switch driving signal DSR.

In the embodiment, the fourth switching component 610 includes, for example, a fourth transistor T4, in which the drain (corresponding to first terminal) of the fourth transistor T4 is electrically connected to the first terminal of the first coil 111, the source (corresponding to second terminal) of the fourth transistor T4 is electrically connected to the second terminal of the first coil 111 and the gate (corresponding to third terminal) of the fourth transistor T4 receives the switch driving signal DSR.

In the above-mentioned embodiments, the switch driving signals DS and DSR can be provided by, for example, a control chip. When the control chip includes a timing controller, the switch driving signals DS and DSR can be provided by the timing controller, which the feasible embodiment of the invention is not limited to. When the timing controller is used for controlling, the backlight sources at different positions can be further controlled to achieve local backlight control effect according to the displayed image, which further can have high contrast or power-saving advantages. In particular, the switch driving signal DS can be a sequence pulse-wave signal for periodically controlling the switching operation of a switching component (for example, 320 or 520). Meanwhile, the switch driving signal DSR can be another sequence pulse-wave signal inverted to the switch driving signal DS for periodically controlling the switching operation of another switching component (for example, 410 or 610). The people skilled in the art should understand the sequence pulse-wave signal herein is an example only and does not limit the feasible embodiment of the invention.

Figure 7B:
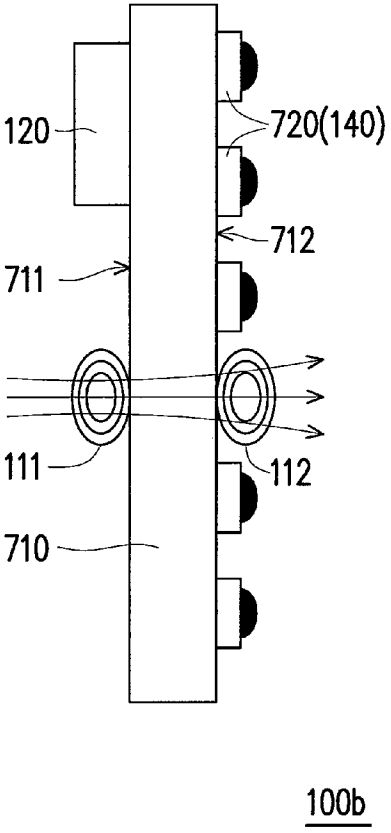
FIG. 7B is a schematic diagram of the backlight module structure of FIG. 1 according to another embodiment of the invention.
Figure 7A:
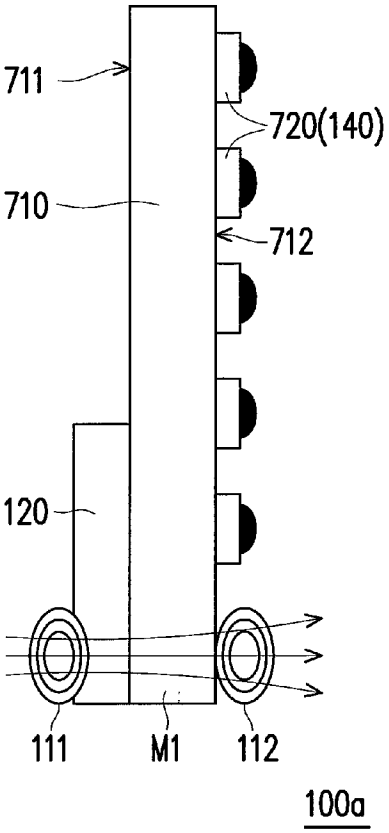
FIG. 7A is a schematic diagram of the backlight module structure of FIG. 1 according to an embodiment of the invention.

FIG. 7A is a schematic diagram of the backlight module structure of FIG. 1 according to an embodiment of the invention. Referring to FIGS. 1 and 7A, in the embodiment, a backlight module 100*a* further includes a first substrate 710 with a first surface 711 and a second surface 712 opposite to the first surface 711. The first driving circuit 120 and the first coil 111 herein can be disposed on the first surface 711 of the first substrate 710. The first driving circuit 120 is disposed in alignment with a side of the first substrate 710, in which the first driving circuit 120 is disposed between the first coil 111 and the first surface 711 of the first substrate 710.

The light emitting unit 140 herein is composed of, for example, a plurality of LED light bars 720, and the LED light bars 720, the second coil 112 and the rectifying circuit 130 are disposed on the second surface 712 of the first substrate 710, while the second coil 112 is disposed out of the LED light bars 720 and adjacent to a side of the first substrate 710. The second coil 112 can be a coil pattern printed on the first substrate 710.

According to the layout of FIG. 7A, the first coil 111 and the second coil 112 are, at least, partially overlapped with each other, so that after the first coil 111 produces the first magnetic field M1 under the controlling of the first driving circuit 120, the second coil 112 can produce the first induction voltage IV1 according to the first magnetic field M1. Thereafter, the rectifying circuit 130 converts the first induction voltage IV1 into a first driving voltage DP1 so that the LED light bars 720 emit light to provide the backlight.

FIG. 7B is a schematic diagram of the backlight module structure of FIG. 1 according to another embodiment of the invention. Referring to FIGS. 7A and 7B, in the embodiment, the backlight module 100*b* is similar to the backlight module 100*a* except that the first driving circuit 120 and the first coil 111 are disposed on the first surface 711 of the first substrate 710 and the second coil 112 is disposed between the LED light bars 720, in which the first coil 111 can be a coil pattern printed on the first substrate 710. The relative position between the first driving circuit 120 and the first coil 111 can be adjusted according to the designer skilled in the art, but the position of the second coil 112 needs to be partially overlapped with the position of the first coil 111 so that the second coil 112 can receive the first magnetic field M1 provided by the first coil 111.

Figure 8:
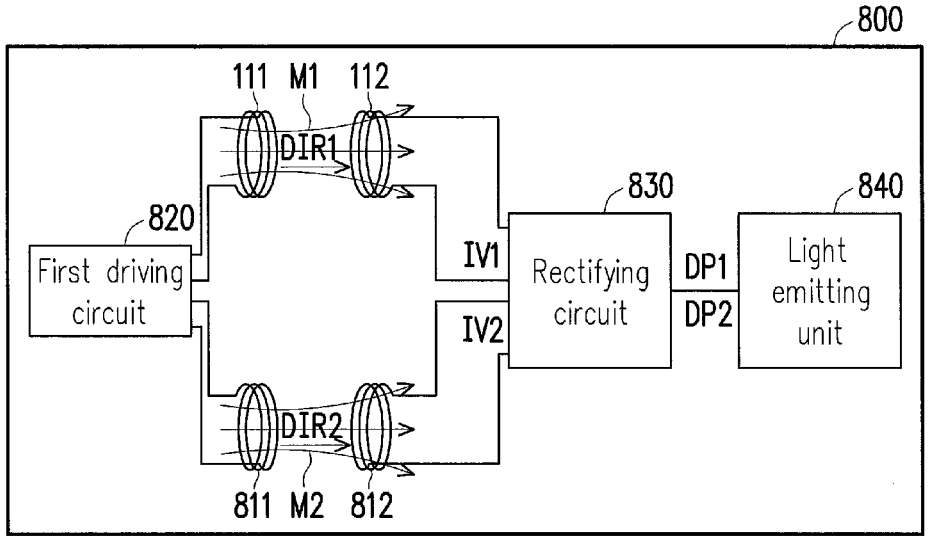
FIG. 8 is a function block diagram of a backlight module according to another embodiment of the invention.

FIG. 8 is a function block diagram of a backlight module according to another embodiment of the invention. Referring to FIGS. 1 and 8, in the embodiment, a backlight module 800 includes a first coil 111, a second coil 112, a third coil 811, a fourth coil 812, a first driving circuit 820, a rectifying circuit 830 and a light emitting unit 840. The first driving circuit 820 is electrically connected to the first coil 111 for controlling the first coil 111 to produce a first magnetic field M1. The second coil 112 is disposed on a transmission direction DIR1 of the first magnetic field M1 corresponding to the first coil 111 for receiving the first magnetic field M1 and providing a first induction voltage IV1 according to the first magnetic field M1. The first driving circuit 820 is electrically connected to the third coil 811 for controlling the third coil 811 to produce the second magnetic field M2. The fourth coil 812 is disposed on a transmission direction DIR2 of the second magnetic field M2 corresponding to the third coil 811 for receiving the second magnetic field M2 and providing a second induction voltage IV2 according to the second magnetic field M2.

The rectifying circuit 830 is electrically connected to the second coil 112 and the fourth coil 812 for converting the first induction voltage IV1 into a first driving voltage DP1 and converting the second induction voltage IV2 into a second driving voltage DP2. The light emitting unit 840 is electrically connected to the rectifying circuit 830 to provide a backlight according to the first driving voltage DP1 and the second driving voltage DP2, in which the light emitting unit 840 includes a plurality of LED light bars.

Although the backlight module 800 is composed of two corresponding pairs of coils (a first pair of coils composed of the first coil 111 and the second coil 112 and another pair of coils composed of third coil 811 and the fourth coil 812). However in other embodiments, the backlight module can be composed of multi pairs of coils according to different applications.

Figure 9:
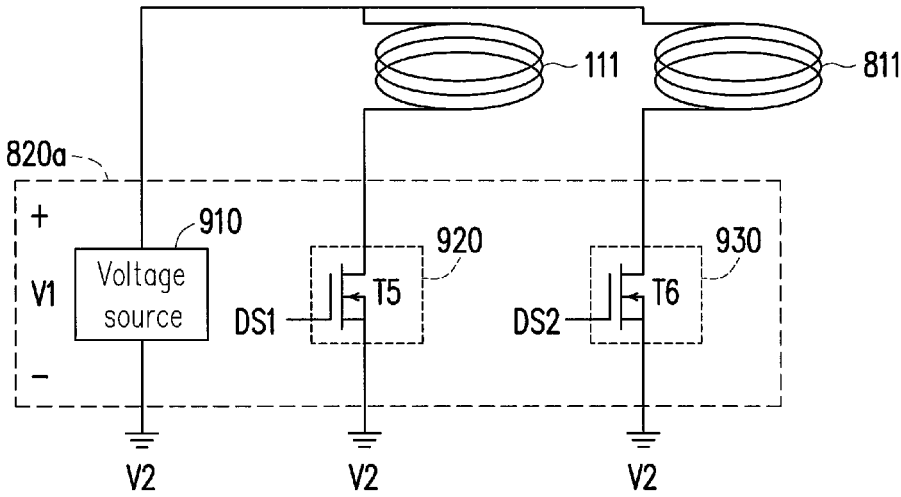
FIGS. 9-12 are schematic diagrams showing the circuit connection between the first driving circuit, the first coil and the third coil according to an embodiment of the invention.

FIG. 9 is a schematic diagram showing the circuit connection between the first driving circuit, the first coil and the third coil according to an embodiment of the invention. Referring to FIGS. 8 and 9, in the embodiment, the first driving circuit 820*a* receives the two switch driving signals DS1 and DS2, and the first driving circuit 820*a* includes a voltage source 910 and two switching components 920 and 930. The first terminal of the voltage source 910 is electrically connected to the first terminal of the first coil 111 and the first terminal of the third coil 811 for providing the first voltage V1 to the first terminal of the first coil 111 and the first terminal of the third coil 811, while the second terminal of the voltage source 910 is electrically connected to the second voltage V2.

The switching component 920 is electrically connected between the second terminal of the first coil 111 and the second voltage V2 and is turned on according to the switch driving signal DS1. When the switching component 920 is turned on, the second voltage V2 can be provided to the second terminal of the first coil 111. The switching component 930 is electrically connected between the second terminal of the third coil 811 and the second voltage V2 and is turned on according to the switch driving signal DS2. When the switching component 930 is turned on, the second voltage V2 can be provided to the second terminal of the third coil 811, in which the first voltage V1 is different from the second voltage V2 and the second voltage V2 can be a ground voltage.

The switching component 920 in the embodiment, for example, includes a transistor T5, in which the drain of the transistor T5 is electrically connected to the second terminal of the first coil 111, the source of the transistor T5 receives the second voltage V2 and the gate of the transistor T5 receives the switch driving signal DS 1. The switching component 930 in the embodiment, for example, includes a transistor T6, in which the drain of the transistor T6 is electrically connected to the second terminal of the third coil 811, the source of the transistor T6 receives the second voltage V2 and the gate of the transistor T6 receives the switch driving signal DS2.

Figure 10:
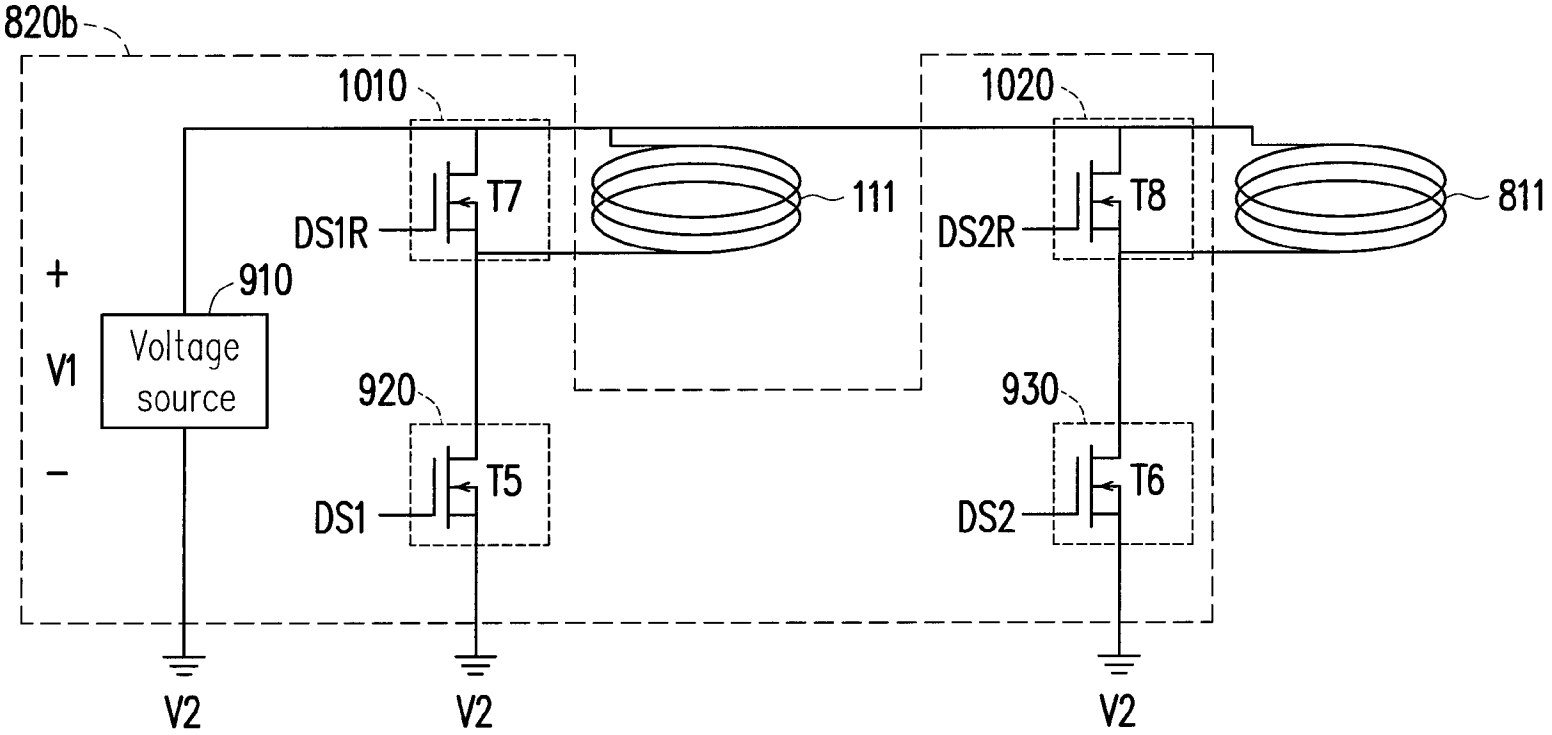

FIG. 10 is a schematic diagram showing the circuit connection between the first driving circuit, the first coil and the third coil according to an embodiment of the invention. Referring to FIGS. 8, 9 and 10, the difference of the embodiment from FIG. 9 rests in that the first driving circuit 820*b* in the embodiment further receives the two switch driving signals DS1R and DS2R and the first driving circuit 820*b* further includes two switching components 1010 and 1020. The switching component 1010 is electrically connected between the first terminal and the second terminal of the first coil 111 and is turned on according to the switch driving signal DS1R (it is, for example, the inverse signal of the switch driving signal DS1). The switching component 1020 is electrically connected between the first terminal and the second terminal of the third coil 811 and is turned on under the controlling of the switch driving signal DS2R (it is, for example, the inverse signal of the switch driving signal DS2). In other words, when the switching component 920 is turned on under the controlling of the switch driving signal DS1, the switching component 1010 is correspondingly turned off under the controlling of the switch driving signal DS1R; when the switching component 930 is turned on under the controlling of the switch driving signal DS2, the switching component 1020 is correspondingly turned off under the controlling of the switch driving signal DS2R.

The switching component 1010 in the embodiment, for example, includes a transistor T7, in which the drain of the transistor T7 is electrically connected to the first terminal of the first coil 111, the source of the transistor T7 is electrically connected to the second terminal of the first coil 111 and the gate of the transistor T7 receives the switch driving signal DS1R. The switching component 1020 in the embodiment, for example, includes a transistor T8, in which the drain of the transistor T8 is electrically connected to the first terminal of the third coil 811, the source of the transistor T8 is electrically connected to the second terminal of the third coil 811 and the gate of the transistor T8 receives the switch driving signal DS2R.

Figure 11:
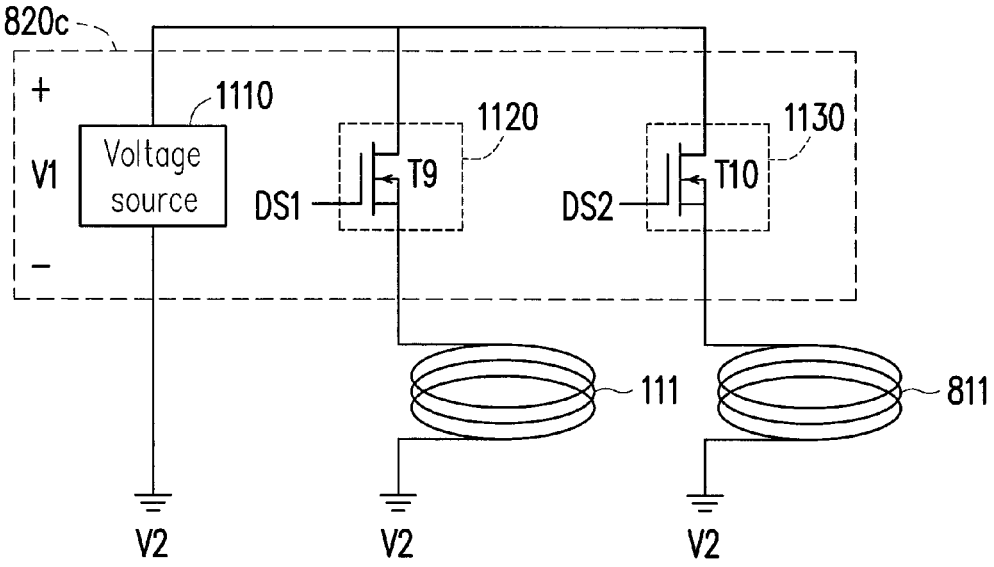

FIG. 11 is a schematic diagram showing the circuit connection between the first driving circuit, the first coil and the third coil according to an embodiment of the invention. Referring to FIGS. 8 and 11, in the embodiment, the first driving circuit 820*c* receives the two switch driving signals DS1 and DS2, and the first driving circuit 820*c* includes a voltage source 1110 and two switching components 1120 and 1130. The voltage source 1110 is for providing the first voltage V1. The first terminal of the switching component 1120 is electrically connected to the first terminal of the voltage source 1110, the second terminal of the voltage source 1110 is electrically connected to the second voltage V2. The first coil 111 is electrically connected between the second terminal of the switching component 1120 and the second voltage V2. The switching component 1120 can be turned on according to the switch driving signal DS1, and when the switching component 1120 is turned on, the first voltage V1 can be provided to the first terminal of the first coil 111.

The first terminal of the switching component 1130 is electrically connected to the first terminal of the voltage source 1110. The third coil 811 is electrically connected between the second terminal of the switching component 1130 and the second voltage V2. The switching component 1130 can be turned on according to the switch driving signal DS2, and when the switching component 1130 is turned on, the first voltage V1 can be provided to the first terminal of the third coil 811.

The switching component 1120 in the embodiment, for example, includes a transistor T9, in which the drain of the transistor T9 is electrically connected to the first terminal of the voltage source 1110. The first coil 111 is electrically connected between the source of the transistor T9 and the second voltage V2. The gate of the transistor T9 receives the switch driving signal DS1. The switching component 1130 in the embodiment, for example, includes a transistor T10, in which the drain of the transistor T10 is electrically connected to the first terminal of the voltage source 1110, and the third coil 811 is electrically connected between the source of the transistor T10 and the second voltage V2 and the gate of the transistor T10 receives the switch driving signal DS2.

Figure 12:
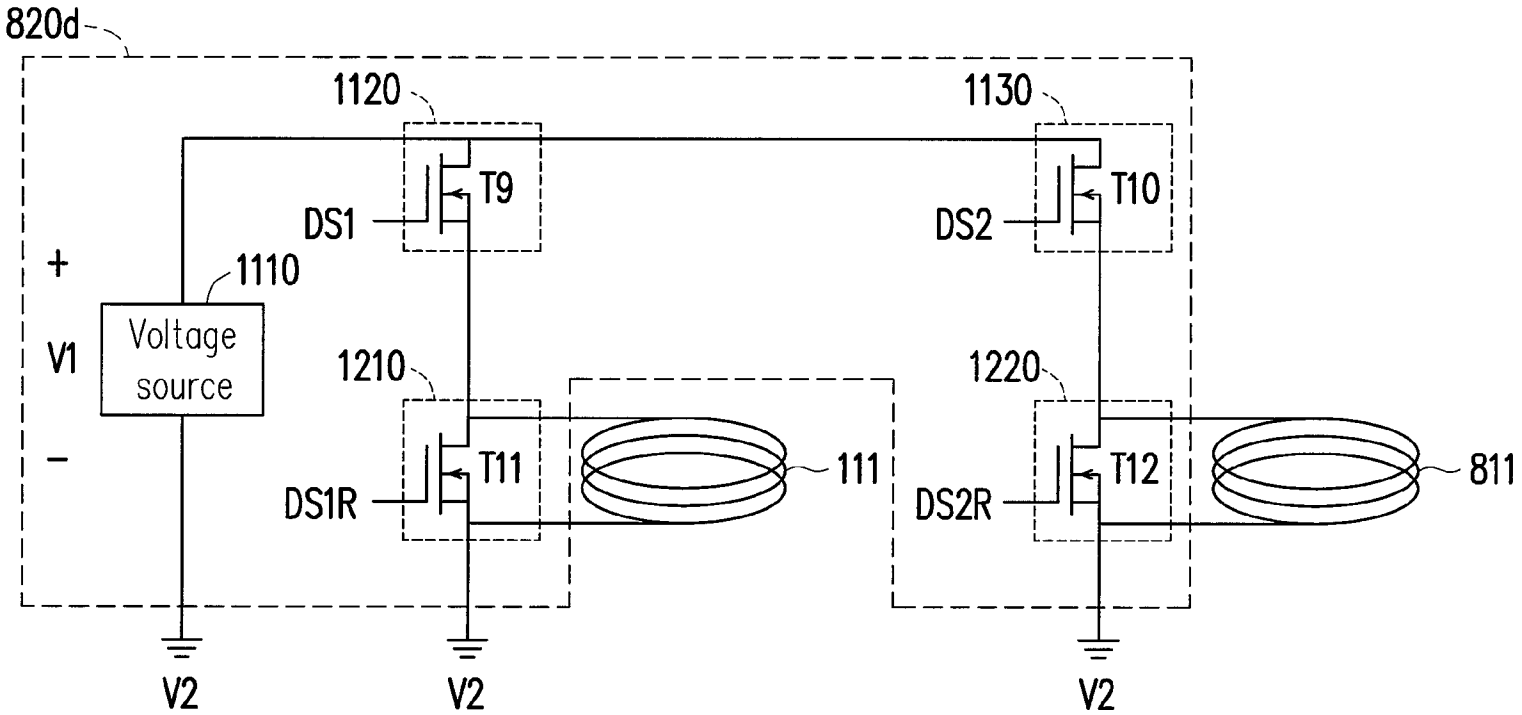

FIG. 12 is a schematic diagram showing the circuit connection between the first driving circuit, the first coil and the third coil according to an embodiment of the invention. Referring to FIGS. 8, 11 and 12, the difference of the embodiment from FIG. 11 rests in that the first driving circuit 820*d* in the embodiment further receives the two switch driving signals DS1R and DS2R and the first driving circuit 820*b* further includes two switching components 1210 and 1220. The switching component 1210 is electrically connected between the first terminal and the second terminal of the first coil 111 and is turned on under the controlling of the switch driving signal DS1R (it is the inverse signal of the switch driving signal DS1). The switching component 1220 is electrically connected between the first terminal and the second terminal of the third coil 811 and is turned on under the controlling of the switch driving signal DS2R (it is the inverse signal of the switch driving signal DS2). In other words, when the switching component 1120 is turned on under the controlling of the switch driving signal DS1, the switching component 1210 is correspondingly turned off under the controlling of the switch driving signal DS1R; when the switching component 1130 is turned on under the controlling of the switch driving signal DS2, the switching component 1220 is correspondingly turned off under the controlling of the switch driving signal DS2R.

The switching component 1210 in the embodiment, for example, includes a transistor T11, in which the drain of the transistor T11 is electrically connected to the first terminal of the first coil 111, the source of the transistor T11 is electrically connected to the second terminal of the first coil 111 and the gate of the transistor T11 receives the switch driving signal DS1R. The switching component 1220 in the embodiment, for example, includes a transistor T12, in which the drain of the transistor T12 is electrically connected to the first terminal of the third coil 811, the source of the transistor T12 is electrically connected to the second terminal of the third coil 811 and the gate of the transistor T12 receives the switch driving signal DS2R.

Following the above-mentioned instruction, the designer skilled in the art can add other coils and the corresponding switching components into the backlight module according to the application requirement, which is omitted to describe.

Figure 13A:
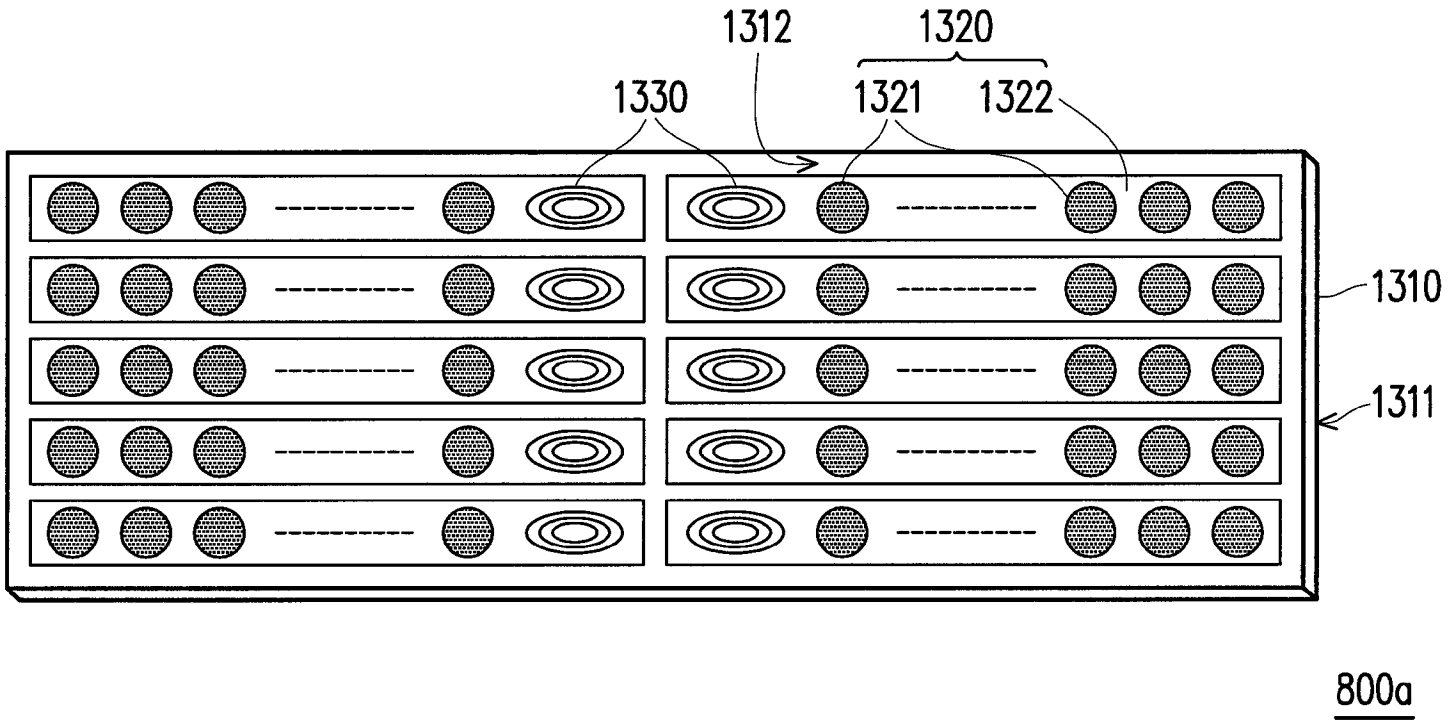
FIG. 13A is a disposing diagram of the light emitting unit, the second coil and the fourth coil according to an embodiment of the invention.

FIG. 13A is a disposing diagram of the light emitting unit, the second coil and the fourth coil according to an embodiment of the invention. Referring to FIGS. 8 and 13A, in the embodiment, a backlight module 800*a* further includes a first substrate 1310 with a first surface 1311 and a second surface 1312 opposite to the first surface 1310. The first driving circuit 820, the first coil 111 and the third coil 811 herein can be disposed on the first surface 1311 of the first substrate 1310. The light emitting unit 840 is composed of, for example, a plurality of LED light bars 1320. The LED light bars 1320, the second coil 112, the fourth coil 812 and the rectifying circuit 830 can be disposed on the second surface 1312 of the first surface 1311.

In the embodiment, each of the LED light bars 1320 includes a plurality of LEDs 1321 and a second substrate 1322, in which the LEDs 1321 are disposed on the second substrate 1322 and each of the second substrates 1322 forms a coil pattern 1330 thereon. In the embodiment of the invention, depending on different circuit applications, the coil patterns 1330 of the LED light bars 1320 can serve as the second coil 112 and/or the fourth coil 812 to receive the first magnetic field Ml and/or the second magnetic field M2 formed by the first coil 111 and/or the third coil 811. In addition, the quantity of the first magnetic field Ml and/or the second magnetic field M2 can be corresponding to the quantity of the coil patterns 1330.

Figure 13B:
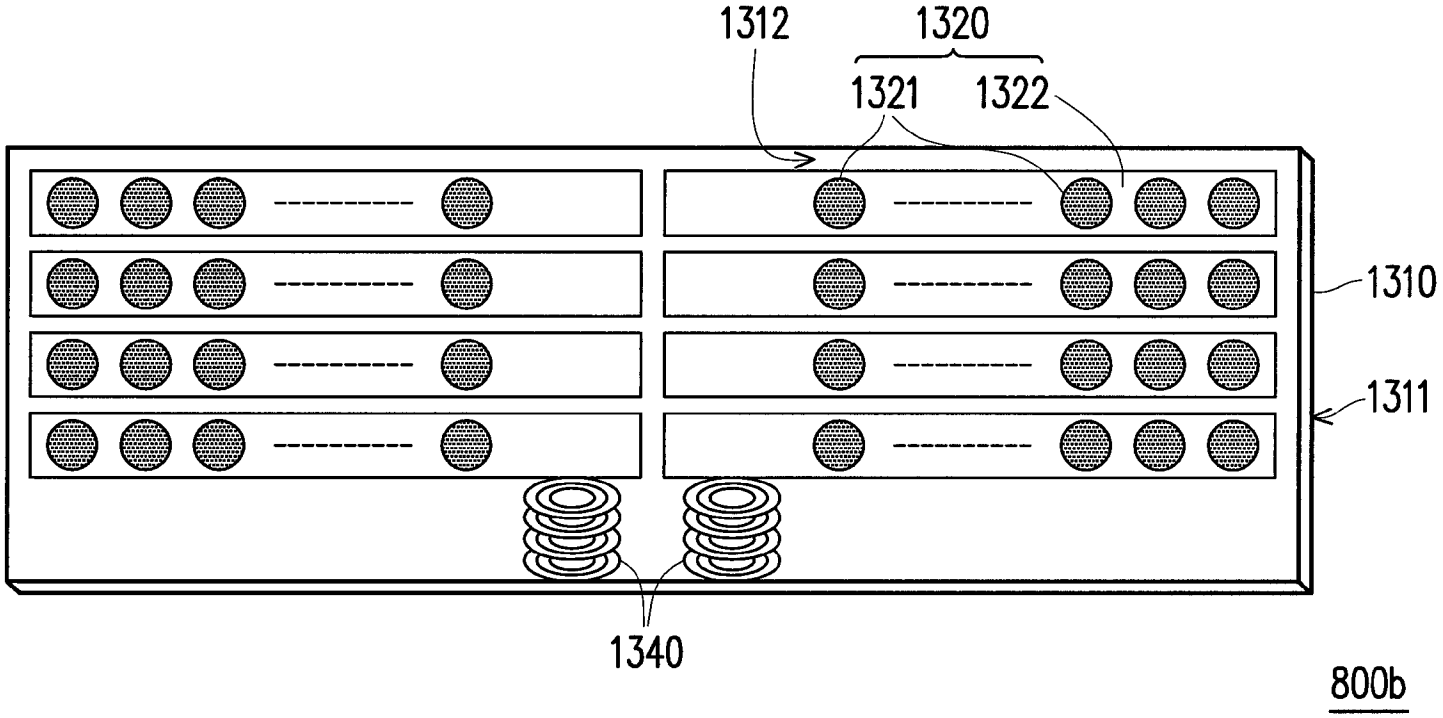
FIG. 13B is a disposing diagram of the light emitting unit, the second coil and the fourth coil according to the embodiment of FIG. 13A.

FIG. 13B is a disposing diagram of the light emitting unit, the second coil and the fourth coil according to an embodiment of the invention. Referring to FIGS. 13A and 13B, in the embodiment, a plurality of coil patterns 1340 are formed on the second surface 1312 of the first surface 1311, in which the quantity of the coil patterns 1340 can be corresponding to the quantity of the LED light bars 1320. In the embodiment of the invention, depending on different circuit applications, the coil patterns 1340 can serve as the second coil 112 and/or the fourth coil 812 to receive the first magnetic field M1 and/or the second magnetic field M2 formed by the first coil 111 and/or the third coil 811. In addition, the quantity of the first magnetic field M1 and/or the second magnetic field M2 can be corresponding to the quantity of the coil patterns 1340.

In summary, the backlight module in the embodiment of the invention takes advantage of the induction action of magnetic fields between the first coil and the second coil to effectively reduce the wiring between the first driving circuit and the light emitting unit and to further reduce the volume of the backlight module. In addition, since no connection circuit between the first coil and the second coil is needed, so that the disposing of the first coil and the second coil has better flexibility and the design of the backlight module accordingly is more flexible.

It will be apparent to those skilled in the art that the descriptions above are several preferred embodiments of the invention only, which does not limit the implementing range of the invention. Various modifications and variations can be made to the structure of the invention without departing from the scope or spirit of the invention. The claim scope of the invention is defined by the claims hereinafter.

What is claimed is:

1. A backlight module, comprising:

a first coil;

a first driving circuit, electrically connected to the first coil for controlling the first coil to produce a first magnetic field;

a second coil, configured to receive the first magnetic field and providing a first induction voltage according to the first magnetic field;

a rectifying circuit, electrically connected to the second coil for converting the first induction voltage into a first driving voltage;

a light emitting unit, electrically connected to the rectifying circuit to provide a backlight according to the first driving voltage; and a first substrate having a first surface and a second surface opposite to the first surface, wherein the first coil and the first driving circuit are disposed at a side of the first substrate the same as the first surface, and the second coil, the rectifying circuit and the light emitting unit are disposed at another side of the first substrate the same as the second surface, wherein the light emitting unit comprises a light emitting diode light bar, and the second coil is disposed at a second substrate of the light emitting diode light bar.

2. The backlight module as claimed in claim 1, wherein the first coil is a coil pattern printed on the first substrate, and the second coil is a coil pattern printed on a second substrate of the light emitting diode light bar.

3. The backlight module as claimed in claim 1, wherein the rectifying circuit is electrically connected between the second coil and the light emitting diode light bar and comprises:

a first diode, wherein anode of the first diode is electrically connected to first terminal of the second coil;

a second diode, wherein cathode of the second diode is electrically connected to the anode of the first diode;

a third diode, wherein anode of the third diode is electrically connected to second terminal of the second coil and cathode of the third diode is electrically connected to the cathode of the first diode;

a fourth diode, wherein cathode of the fourth diode is electrically connected to the anode of the third diode and anode of the fourth diode is electrically connected to the anode of the second diode; and a first capacitor, electrically connected between the cathode of the first diode and the anode of the second diode for providing the first driving voltage.

4. The backlight module as claimed in claim 1, further comprising:

a third coil, electrically connected to the first driving circuit and producing a second magnetic field under controlling of the first driving circuit; and a fourth coil, electrically connected to the rectifying circuit, configured to receive the second magnetic field and provide a second induction voltage to the rectifying circuit according to the second magnetic field;

wherein the rectifying circuit converts the second induction voltage into a second driving voltage, and the light emitting unit provides the backlight according to the first driving voltage and the second driving voltage.

5. A backlight module, comprising:

a first coil;

a first driving circuit, electrically connected to the first coil for controlling the first coil to produce a first magnetic field, and configured for receiving a switch driving signal and the first driving circuit;

a second coil, configured to receive the first magnetic field and providing a first induction voltage according to the first magnetic field;

a rectifying circuit, electrically connected to the second coil for converting the first induction voltage into a first driving voltage;

a light emitting unit, electrically connected to the rectifying circuit to provide a backlight according to the first driving voltage; and a first substrate having a first surface and a second surface opposite to the first surface, wherein the first coil and the first driving circuit are disposed at a side of the first substrate the same as the first surface, and the second coil, the rectifying circuit and the light emitting unit are disposed at another side of the first substrate the same as the second surface, wherein the first driving circuit comprises:

a voltage source, electrically connected to first terminal of the first coil for providing a first voltage to the first terminal of the first coil;

a first switching component, electrically connected between second terminal of the first coil and a second voltage for providing the second voltage to the second terminal of the first coil according to the switch driving signal; and a second switching component, electrically connected between the first terminal and the second terminal of the first coil and turned on according to inverse signal of the switch driving signal, wherein the first switching component comprises a first transistor, first terminal of the first transistor is electrically connected to the second terminal of the first coil, second terminal of the first transistor receives the second voltage and control terminal of the first transistor receives the switch driving signal, and wherein the second switching component comprises a second transistor, first terminal of the second transistor is electrically connected to the first terminal of the first coil, second terminal of the second transistor is electrically connected to the second terminal of the first coil and control terminal of the second transistor receives the inverse signal of the switch driving signal.

6. A backlight module, comprising:

a first coil;

a first driving circuit, electrically connected to the first coil for controlling the first coil to produce a first magnetic field;

a second coil, configured to receive the first magnetic field and providing a first induction voltage according to the first magnetic field;

a rectifying circuit, electrically connected to the second coil for converting the first induction voltage into a first driving voltage;

a light emitting unit, electrically connected to the rectifying circuit to provide a backlight according to the first driving voltage; and a first substrate having a first surface and a second surface opposite to the first surface, wherein the first coil and the first driving circuit are disposed at a side of the first substrate the same as the first surface, and the second coil, the rectifying circuit and the light emitting unit are disposed at another side of the first substrate the same as the second surface, wherein the first driving circuit is also used to receive a switch driving signal and the first driving circuit comprises:

a voltage source for providing a first voltage;

a first switching component, electrically connected between the voltage source and first terminal of the first coil for providing the first voltage to the first terminal of the first coil according to the switch driving signal; and a second switching component, electrically connected between the first terminal and second terminal of the first coil and turned on according to inverse signal of the switch driving signal.

7. The backlight module as claimed in claim 6, wherein the first switching component comprises a first transistor, first terminal of the first transistor is electrically connected to the voltage source, second terminal of the first transistor is electrically connected to the first terminal of the first coil and control terminal of the first transistor receives the switch driving signal;

the second switching component comprises a second transistor, first terminal of the second transistor is electrically connected to the first terminal of the first coil, second terminal of the second transistor is electrically connected to the second terminal of the first coil and control terminal of the second transistor receives the inverse signal of the switch driving signal.

8. The backlight module as claimed in claim 6, wherein the switch driving signal is provided by a control chip, the control chip comprises a timing controller and the switch driving signal is provided by the timing controller.

* * * * *